United States Patent [19]

Gere

[11] 4,060,951

[45] Dec. 6, 1977

[54] STRESSLESS SUSPENSION AND ANCHORING PROCESS OF STONE VENEER

[76] Inventor: Sandor Gere, 22-48 74th St., Jackson Heights, N.Y. 11370

[21] Appl. No.: 723,660

[22] Filed: Sept. 15, 1976

[51] Int. Cl.[2] ..... E04B 2/88; E04B 1/41

[52] U.S. Cl. ..... 52/508; 52/235; 52/511; 52/713

[58] Field of Search ..... 52/508, 511, 235, 706, 52/708, 713, 264, 741

[56] References Cited

U.S. PATENT DOCUMENTS 3,248,836 5/1966 Monk ..... 52/235

*Primary Examiner*—John E. Murtagh

*Attorney, Agent, or Firm*—Marcus J. Millet

[57] ABSTRACT

Disclosed is a new mechanical assembly of metal elements designed to rigidly suspend and positively anchor stone slabs to a building structure. This mechanical assembly provides an plug and stud in the stone slab which resists gravity loading and is able to receive the firm attachment of a supporting structure, without introducing bolting stresses into the stone slabs.

4 Claims, 6 Drawing Figures

STRESSLESS SUSPENSION AND ANCHORING PROCESS OF STONE VENEER

BACKGROUND OF THE INVENTION

1. Field of the Invention

This invention relates to mounting of stone slabs to structures. However it is especially suited to those slabs which are located above windows, or other openings in a building facade, where the bottom of the stone slabs are exposed and where no metal weight relieving objects are permitted beneath the bottom edge of the stone veneer.

2. Description of Prior Art

In the prior art it is possible to suspend and anchor stone slabs with exposed edges above an opening without using exposed metal supports under the bottom edge of the stone veneer. However, the prior art attachments generally depend upon stone liners which are epoxied or glued with other bonding agents to the back of the stone slabs. Because the life expectancy of epoxies and/or the other bonding agents is not yet known and since the proper adhesion of such bonding agents is dependent upon numerous factors including temperature and other atmospheric conditions, as well as the workmanship of the shop or field labor, the prior art has for safety's sake also "nailed" the glued stone liners to the stone slabs. This "nailing" was usually accomplished with metal dowels drilled through the liners into the stone slabs at an angle oblique to the face of the stone slabs. The above described stone liner suspension and anchoring technique has many disadvantages, the major disadvantage being that the technique is very expensive. Also if the technique is performed in the field with field labor sufficient quality control is hardly possible under field conditions. If on the other hand, it is performed in the shop, the technique provides a significant transportation problem due to the mandated expensive packing and high risk of breakage.

Prior art has also used shaped horizontal slots in the back of the stone slabs to receive metal relieving angles or plates for suspension and anchoring. However, this technique is not adoptable to thin veneer and when used in thicker stone slabs, it weakens the stone slabs. Furthermore, its adjustablity is very limited.

Another technique used by prior art consists of tapped and threaded metal plugs drilled in stone slabs for lateral connections and/or for hanging soffits. In both cases the threaded rod which is engaged into the plug, through the back of the stone slab works on tension or compression which, as noted above, are undesirable.

Finally, prior art has used metal angles or other metal shapes attached to stone as a gravity connection. This technique was performed with either expansion bolts - introducing stresses in the stone slabs, or with slightly bent threaded rods epoxied into the back of the stone slabs. However neither the expansion bolt, nor the epoxied bar technique is suitable for thin veneer suspension and retention.

SUMMARY OF THE INVENTION

The prime object of this invention is to provide a positive gravity connection in a stone slab above its bottom edge which is safely applicable in both thick stone slabs as well as in thin stone veneer.

A second object of this invention is to avoid the reliance upon the long time adhesive performance of epoxy or other bonding agents which as stated above is not definitely known.

Another object of this invention is to avoid the introduction of stresses in the stone slabs when any object for gravity connection is attached to it.

Still a further object of this invention is to provide a suspension technique, which simultaneously resists gravity loading and retains the stone slabs as lateral connections.

Finally an object of this invention is to provide a positive gravity and lateral connection which is (1) safe in fabrication; (2) eliminates shipping problems; (3) creates no hazards; (4) creates no increased costs in field assembly, and; (5) provides speedy erection and adjustability in and out, vertically and horizontally.

In accordance with a preferred embodiment of the present invention, round plugholes are drilled in the edges of the stone slab with matching perpendicularly drilled round holes through the back of the stone slab, so that threaded studs may be engaged in the tapped and threaded plugs which are inserted into the round holes in the side joint It has been found that proportionally selected plugholes and plugs are very safe and positive connections which resist very high gravity loads and which also perform very well under positive and negative windloads. A metal disk or other shape threaded plate is attached fingertight on the back of the stone slab to the threaded rod. A thin epoxy, or some other filler material is used to fill the small gap between the plughole in the stone slab and the metal plug, as well as between the threaded disk and the back of the stone slab in order to provide a firm and even contact between the stone and metal surface. The threaded disk provides the surface to which a metal liner, relieving angle, bentplate anchor, channel or other shaped metal connection is tightened by action of a nut on the stud, without introducing any stresses into the stone slabs by tightening the nut. The tightening force is only limited by the capacity of the anchor stud in tension. The metal liner is provided with a formed or welded nipple which results in an automatically locked anchoring into the back-up support. In lieu of the nipple the liner may be bolted, or welded to the back-up support.

The weight of the stone on the plug and stud is resisted by the shear resistance capacity of the metal stud.

The above mentioned objects, features and advantages of the invention, together with others inherent in the same, are highlighted by the assembly drawings illustrating the attachment elements, the same being merely preferred examplary forms, and are described more particularly as follows:

IN THE DRAWINGS

DESCRIPTION

Figure 1:
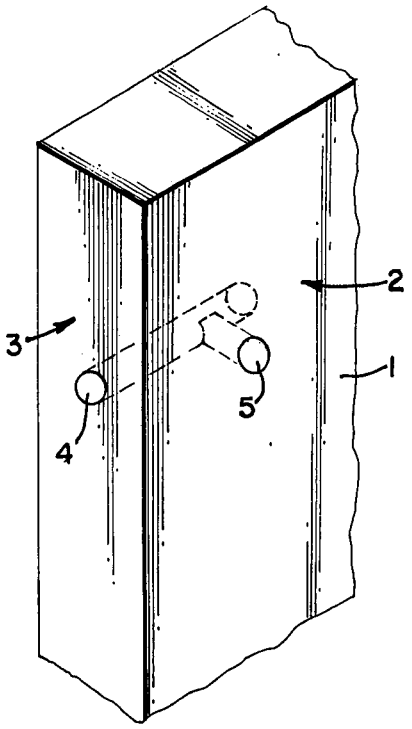
FIG. 1 is an isometric view of a stone veneer drilled with round plughole in an edge and with matching round hole in the back to receive a threaded stud.

Refer now to FIG. 1 for a description of the preferred embodiment of the drilled stone slab 1. The cylindrical plughole 4 is centered on edge 3 and extends axially into slab 1. The diameter of the plughole shall be in proportion with the thickness of the stone slab and shall be sized so that the plug will be able to receive the threaded stud necessary to resist the deadload and other criteria established by the architect and/or engineer. The depth of the plughole is determined by the physical characteristics of the stone slab and by the location of the back-up supporting structure. A bolthole 5 is drilled into the face 2 of the stone slab perpendicularly to plughole 4, locating it so that it matches the location of the tapped threaded hole in the metal plug so that no part of the metal plug protrudes beyond the edge of the stone slab. The diameter of the bolthole can be the same as the diameter of the plughole.

Figure 2:
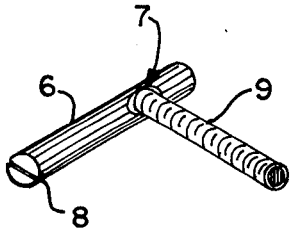
FIG. 2 is an isometric view of a metal plug, together with a threaded stud.

FIG. 2 shows the preferred embodiment of the metal plug 6 and externally threaded stud 9. Plug 6 is cylindrical and is provided with an internally threaded bore 7 perpendicular to its axis, which receives and engages stud 9. A slot 8 is provided in one end of plug 6 so that it may be rotated about its axis for alignment of bore 7 with stud 9 during assembly. To facilitate assembly, the ends of bore 7 may be countersunk.

Figure 3:
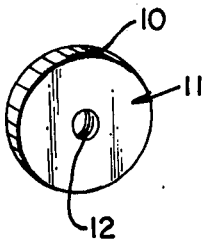
FIG. 3 is an isometric view of a metal plate, with a threaded hole in its center.

FIG. 3 shows the preferred embodiment of a plate 10 having an internally threaded bore 12. The plate has a flat surface 11 and another flat surface, not visible in this view which is parallel to surface 11. Internally threaded bore 12 extends between the two surfaces and is perpendicular to them. The threads within bore 12 are sized to mesh with the threads of stud 9, shown in FIG. 2. In this preferred embodiment, the plate is round, but other shapes may be used without departing from the principle of this invention.

Figure 4:
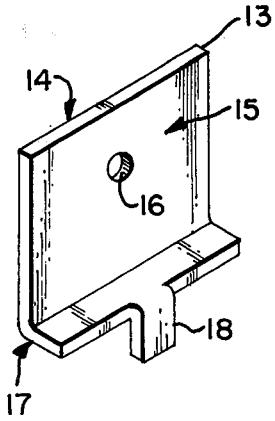
FIG. 4 is an isometric view of a metal liner.

FIG. 4 shows the preferred embodiment of the metal liner 13. The liner has a front surface 14, of which only the edge is visible in this view, a rear surface 15 and a through bore 16 connecting the front surface with the rear surface. The through bore is not threaded, and is of diameter to clear the stud. A bearing surface 17 is formed integrally with liner 13, as is a tongue 18 depending from said bearing surface 17 remote from a parallel with front surface 14.

Figure 5:
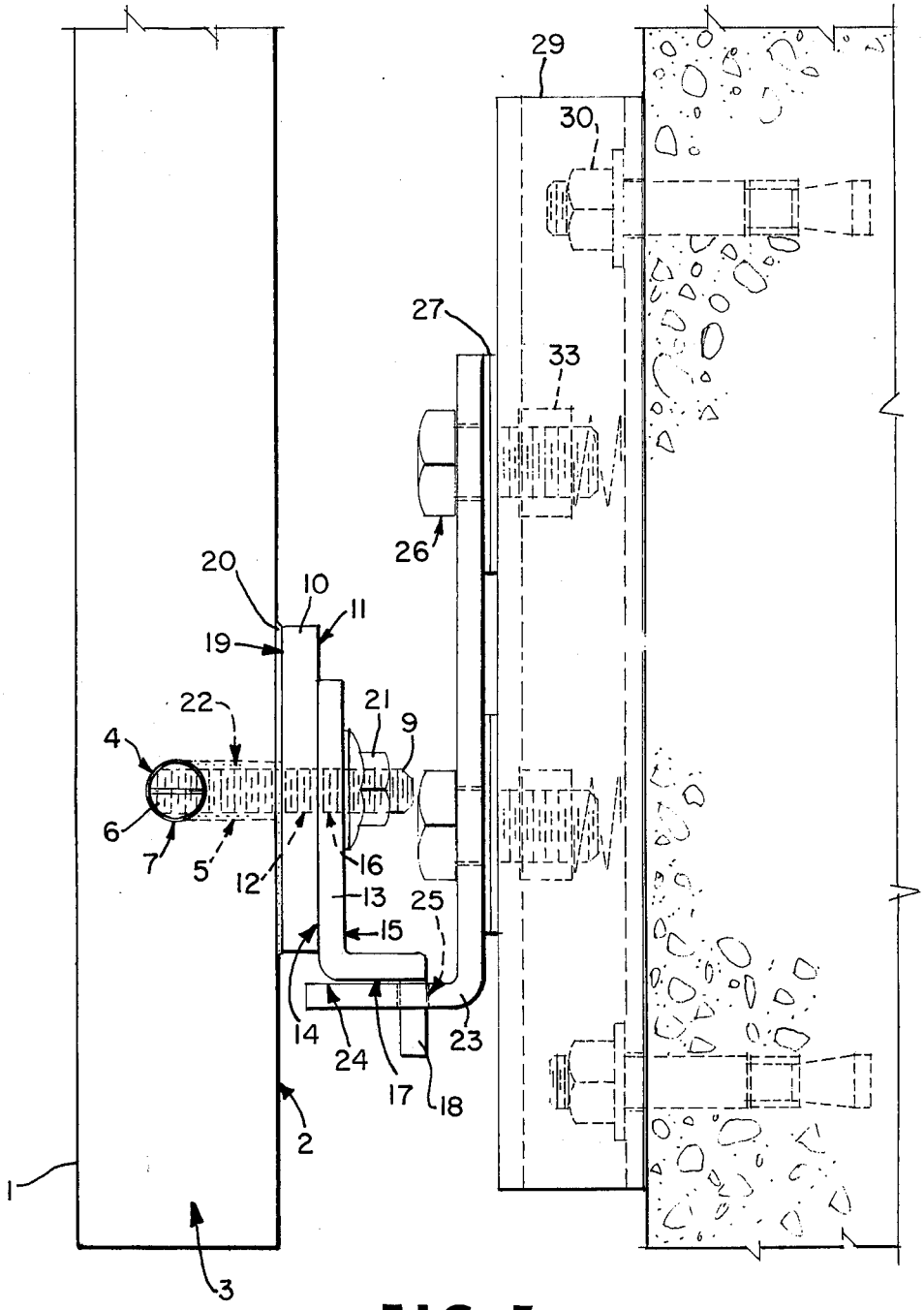
FIG. 5 is a schematic representation in a vertical section of a preferred embodiment of the assembly.
Figure 6:
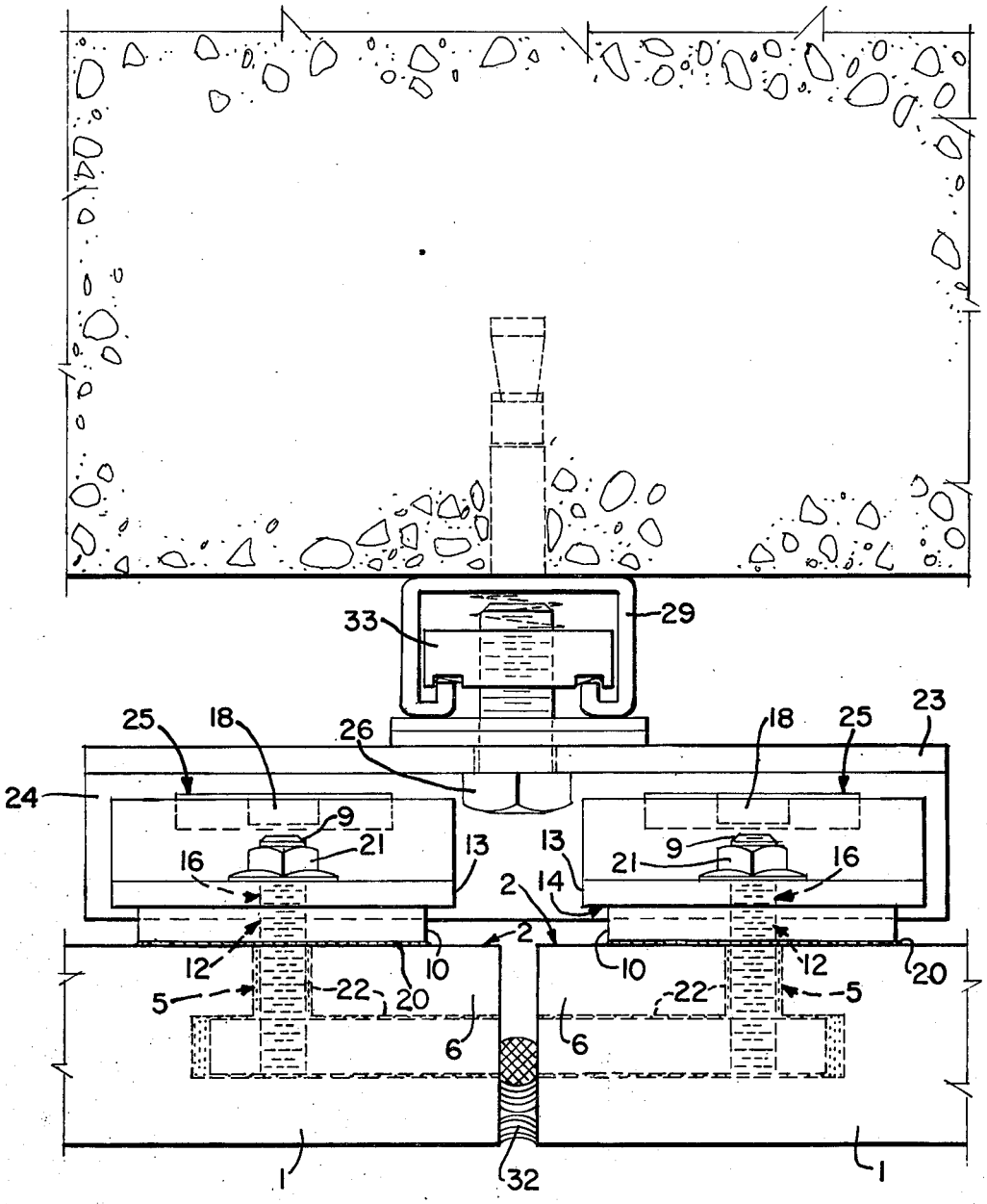
FIG. 6 is an another view of same, shown in horizontal plan section.

The assembly of the components in one preferred embodiment is shown in FIGS. 5 and 6. Plug 6 is positioned coaxially within plughole 4 of stone slab 1, with internally threaded bore 7 in alignment with bolthole 5 of slab 1. Stud 9 is in engagement with internally threaded bore 7, and extends outwardly through bolthole 5 beyond the face 2 of slab 1. Plate 10 is mounted to stud 9 with internally threaded bore 12 in mesh with the external threads of stud 9. Note that one surface 19 bears on face 2 of slab, while the other surface 11 faces away from slab 1. As is well known to those skilled in the art, machined stone surfaces such as face 2 and the interiors of plughole 4 and bolthole 5 are never free from irregularities. Therefore, to promote even distribution of contact stresses between the stone slab and the other components of the assembly, it is advantageous to use a filler material 22 within the plughole and bolthole, surrounding plug 6 and stud 9. It is also advantageous to use a film of filler material 20 between plate surface 19 and face 20. Because the elements of the assembly securely lock the stone slab to the support, it is not necessary that the filler material have any bonding characteristics. Any material which can be formed into position and which will resist flow once in position will be satisfactory. Such materials are well known to those skilled in the art of stone-setting, examples are epoxies and sulphur. Note that the front surface 14 of liner 13 bears on surface 11 of plate 10. Stud 9 extends through the through-bore 16 of the liner, beyond its rear surface 15. Nut 21 is in engagement with the external threads of stud 9, bearing on rear surface 15 to force liner 13 against plate 10. It should be noted that the force exerted by the nut is not borne by the stone slab, but rather by the internal threads of plate 10. Thus, the assembly of the nut to the stud can be made by inexperienced field labor without cracking the stone slab during assembly.

In the embodiment shown in FIGS. 5 and 6, the bearing surface 17 of liner 13 is in contact with a bearing surface 24 of an intermediate supporting element 23. Tongue 18 of liner 13 is recieved in hole 25 of the intermediate supporting element.The intermediate supporting element is itself mounted to the structure 31 by conventional means; in FIG. 5, it is depicted with bolts 26, washers 27 and nuts 33 cooperating to anchor it to a chanel 29. Channel 29 is mounted by means of expansion anchors 30 to the supporting concrete structure. It is to be appreciated that the mode of attachment of intermediate supporting element 23 to the supporting structure 31, are conventional and well known to those skilled in the art. These will vary with the type and condition of the supporting structure. The essential elements of intermediate supporting element 23 are the bearing surface 24 and the hole 25. The bearing surface 24 is depicted as running horizontally in FIG. 5 because the major load being transmitted is the gravity loading imposed by the weight of stone slab 1. Tongue 18 in hole 25 serves to retain the liner in the "lateral" mode, transverse to the direction of the gravity loading.

As an alternative to the use of intermediate supporting structure 23, any of the common means of attaching a metal liner to a structure may be used to couple liner 13 to structure 31. These include welding or bolting.

FIG. 6, depicting the embodiment in horizontal plan section, shows how two or more slabs may be mounted to the same intermediate supporting structure 23. The arrangement of stud 9, nut 21, liner 13, plate 10 and slab 1 is shown, as is the position of plug 6 in plughole 4. It is advantageous to position plug 6 so that it is flush with edge 3 of slab 1. In this manner, adjacent slabs may be placed closely. The common practice of the art when setting stones is to place a joint sealant, shown as 32, in the space between the stones.

The assembly of the attachment to the stone is normally accomplished in the field. First, the plughole is bored into the slab perpendicular to the plughole from the face of the slab to which the attachment is to be made and perpendicular to the face of the slab. The plug is inserted into the plughole and positioned so that the internally threaded bore of the plug is aligned with the bolthole. The screwdriver slot 8, shown in FIG. 2, may be used to rotate the plug about its axis to align the internally threaded bore of the plug with the bolthole in the slab. The externally threaded stud is threaded into the internally threaded bore of the plug through the bolthole. A filler material, as described above, is poured into the bolthole and plughole to surround the stud and plug and promote even distribution of contact stresses. The most convenient method of pouring the filler material is to close the plughole with a piece of tape and pour the filler in through the bolthole. A film of filler material may also be applied to the face of the stone slab adjacent to the bolthole, in the area where the plate is to bear upon the slab. The plate is threaded onto the stud with the internally threaded bore of the plate engaging the external threads of the stud, until the plate is finger-tight against the slab. The liner is then applied against the plate, and forced against the plate by a nut which is threaded onto the stud. While the nut is being threaded onto the stud, the stone slab is protected by the plate from the forces generated by the nut. Thus, no special care need be taken while tightening the nut. The liner is then attached to the supporting structure, thus mounting the slab to the structure.

In the preferred embodiments, the plug, stud, liner and nut are metal. The exact metal to be used is determined by considerations well known to those skilled in the art of stone-mounting: cost, strength, corrosion resistance and ease of fabrication.

What is claimed is:

1. A stone slab mounting comprising:

a. a stone slab having a face and an edge, a cylindrical plughole extending axially into the slab from the edge, and a bolthole perpendicular to the plughole and the face communicating with the plughole and the face;

b. a cylindrical plug having an internally threaded bore perpendicular to its axis, positioned within said plughole with the internally threaded bore of the plug in alignment with said bolthole;

c. a stud having external threads in engagement with the internally threaded bore of said plug, extending outwardly through said bolthole beyond said face of said slab;

d. a plate having a first flat surface, a second flat surface parallel to said first surface, and an internally threaded bore perpendicular to said surfaces extending from said first surface to said second surface, mounted to said stud with the internally threaded bore of said plate in engagement with the external threads of said stud, with the first surface of said plate bearing on the face of said slab;

e. a liner having a front surface and a rear surface and a through bore connecting said front surface with said rear surface, positioned on said stud with said front surface bearing on the second surface of said plate and said stud extending through said through bore, beyond the rear surface of said liner;

f. a nut in engagement with the external threads of said stud bearing on the rear surface of said liner to force said liner against said plate;

g. a filler material within said plughole and said bolthole, surrounding said plug and said stud to ensure even distribution of contact stresses; and h. means for mounting said liner to a structure for transmission of loads between the slab and the structure.

2. A stone slab attachment as set forth in claim 1, further comprising a filler material between said plate and said face of said slab, to promote even distribution of contact stresses between said plate and said slab.

3. A stone slab attachment as set forth in claim 1, wherein said means for mounting said liner to a structure comprises a bearing surface integral with said liner perpendicular to said front surface of said liner, a tongue integral with said liner depending from said bearing surface remote from said front surface of said liner and parallel thereto intermediate supporting element having a bearing surface in contact with said bearing surface of said liner and a hole in said bearing surface receiving said tongue, and means for mounting said intermediate supporting element to a structure.

4. A method of mounting a stone slab to a structure comprising:

a. boring plughole into the slab from edge of the slab;

b. boring a bolthole into the slab from a face of the slab to the plughole at right angles to the face of the slab and the plughole;

c. inserting a plug having an internally threated bore into the plughole so that the internally threaded bore is in alignment with the bolthole;

d. threading an externally threaded stud into the internally threaded bore of the plug through the bolthole;

e. pouring a filler material into the bolthole and plughole, and applying a film of filler material to the face of the slab adjacent to the bolthole;

f. threading an internally threaded plate onto the stud until it bears on the face of the slab finger-tight;

g. applying a liner against the plate and forcing the liner against the plate by means of a nut on the stud;

h. attaching the liner to the supporting structure.

* * * * *